United States Patent [19]

Yamamoto et al.

[11] 4,432,257

[45] Feb. 21, 1984

[54] SHOE BOLT SECURING AND REMOVING APPARATUS

[75] Inventors: Kazuyoshi Yamamoto; Tadashi Sato, both of Sagamihara, Japan

[73] Assignee: Caterpillar Mitsubishi Limited, Kanagawa, Japan

[21] Appl. No.: 379,020

[22] Filed: May 17, 1982

[51] Int. Cl.[3] ..... B25B 23/00

[52] U.S. Cl. ..... 81/464; 81/57.25; 81/57.41; 81/55

[58] Field of Search ..... 81/463, 464, 55, 56, 81/57.24, 57.25, 57.4, 57.41

[56] References Cited

U.S. PATENT DOCUMENTS

| | | | |
|---|---|---|---|
| 2,898,792 | 8/1959 | Fox et al. | 81/57.41 |
| 3,108,507 | 10/1963 | Quarve | 81/57.25 |
| 3,142,210 | 7/1964 | Rodgers | 81/57.25 |

*Primary Examiner*—James L. Jones, Jr.

*Attorney, Agent, or Firm*—Robert E. Burns; Emmanuel J. Lobato; Bruce L. Adams

[57] ABSTRACT

A shoe bolt securing and removing apparatus which includes a carriage movable along rails, a mounting framework movably supported on said carriage for movement transversely of said rails, a power driven rotary bolt turning tool mounted on said mounting framework for upward and downward movement, means supported on said mounting framework for moving said bolt turning tool upwardly and downwardly, a nut holder support supported on said mounting framework for upward and downward movement, means supported on said mounting framework for moving said nut holder support upwardly and downwardly and a nut holder supported on said nut holder support below said bolt turning tool for movement back and forth transversely of said rails, said nut holder including a nut receiving portion having the center axis adapted to align with the center axis of said bolt turning tool in a vertical plane in the advanced position of the nut holder.

7 Claims, 7 Drawing Figures

SHOE BOLT SECURING AND REMOVING APPARATUS

BACKGROUND OF THE INVENTION

This invention relates to a shoe bolt securing and removing apparatus for connecting and disconnecting between track links and track shoes in the track chain of a track type vehicle.

Hithertofore, in order to secure or remove shoe bolts which fixedly connect between track links and track shoes in a track chain of a track type vehicle, when the chain is newly assembled or repaired or serviced, the usual way has been to lay the chain 1 flat so that the track shoes 4 rest on track links 2 (for assembling a new chain 1) or the chain 1 is placed on a conveyor in an extended condition (for repairing or servicing the chain) as shown in FIG. 1, the nut wrench 6 (as shown in FIG. 2) is inserted into the opening in one of the series of track links 2 to engage one of nuts 8 positioned below the associated track shoe 4 so as to hold the one nut against turning and the shoe bolt wrench delivers an impact rotation to the bolt head of associated shoe bolt 10 so as to turn the bolt for securing the bolt to or removing the bolt from the track chain 1. The same procedure is repeated for the other shoe bolts 10 to complete the assembly or disassembly of the track chain.

One example of the type of shoe bolt wrench generally useful for the above-mentioned purpose is illustrated in FIG. 3. The shoe bolt wrench includes a carriage 12 slidably movable along a conveyor and an elongated frame 14 supported in the center 14' in the longitudinal direction thereof on the carriage 12. The height of the frame 14 with respect to the carriage 12 is adjustable by the use of a jack 16 and the frame is rockable about the center 14' in horizontal and vertical planes. The frame 14 has an impact wrench 18 mounted at one end for fastening or loosening a shoe bolt and an electric motor 20 mounted at the other end for concurrently driving the impact wrench 18 and serving as a counter weight to balance the frame 14. In order to deliver an impact to the head of a shoe bolt to turn the bolt by the use of the shoe bolt wrench, each time one shoe bolt is secured to or removed from the track chain, the carriage 12 is moved along the conveyor to a suitable position for the operation and the handle 22 mounted on the frame 14 is turned to rock the frame 14 until the socket of the impact wrench 18 fits on the head of the shoe bolt. In addition to the above-mentioned type shoe bolt wrench, hydraulic and pneumatic shoe bolt wrenches are known in which hydraulic or air pressure is employed as drive means for the impact wrench 18 in place of the electric motor 20 as provided in the above-mentioned motor driven type shoe bolt wrench. In addition to the difference with respect to drive means, the hydraulic or pneumatic shoe bolt wrench differs from the motor-driven shoe bolt wrench in the fact that a counter weight is mounted on the frame 14 in the position where the electric motor 20 would be positioned in the motor driven type shoe bolt wrench and the hydraulic and pneumatic shoe bolt wrenches are similar to the motor driven shoe bolt wrench with respect to other components.

However, in any one of the above-mentioned shoe bolt securing and removing apparatuses, each time one shoe bolt is secured or removed, the shoe bolt wrench and carriage assembly having a substantially heavy weight is moved along a conveyor with the portion of the frame 14 where the impact wrench is mounted being manually upheld and the handle 22 is turned to bodily rock the frame 14 until the socket of the impact wrench 18 comes into alignment with the head of the shoe bolt 8 whereas with respect to the nut, the nut wrench 6 is inserted in the opening in the track link 2 so as to engage the socket thereof on the nut on the shoe bolt shank positioned below the track shoe 4. The nut wrench 18 is required to be manually held in position during the turning of the impact wrench 18. Thus, the shoe bolt securing and removing operation requires two operators one of whom is assigned for the bolt handling with the other assigned for the nut handling and thus, the alignment of the impact wrench 18 with the bolt 10 and that of the nut wrench 6 with the nut 8 are separately carried out which reduces the operation efficiency. Also, the movement of the carriage 12 and the rocking of the frame 14 which are necessary in order to align the socket of the impact wrench 18 with a particular shoe bolt 10, are manually performed. In addition, since the nut wrench 6 is required to be manually held in position as the shoe bolt is turned by the impact wrench 18, the operators are soon physically fatigued, particularly, since the body of the operator is subjected to vibration due to impact generated during the turning of the bolt by the impact wrench 18. Therefore, securing and removing shoe bolts by the use of the conventional shoe bolt securing and removing devices is undesirable from the view point of workers' health. Furthermore, since the impact wrench 18 is designed to rock about the central portion 14' of the frame 14 in the longitudinal direction thereof describing a circle, there is the disadvantage that the socket at the leading end of the impact wrench 18 does not always precisely fit on the bolt head.

SUMMARY OF THE INVENTION

The present invention is to eliminate the disadvantages inherent in the prior art shoe bolt securing and removing apparatus.

According to the present invention, there is provided a shoe bolt securing and removing apparatus which comprises a carriage movable along rails, a mounting framework slidably supported on said carriage for movement transversely of said rails, a power driven bolt turning tool movably supported on said mounting framework for upward and downward movement, means supported on said mounting framework for moving said bolt turning tool upwardly and downwardly, a nut holder support movably supported on said mounting framework for upward and downward movement, means mounted on said mounting framework for moving said nut holder support upwardly and downwardly, and a nut holder supported on said nut holder support below said bolt turning tool for movement back and forth transversely of said rails, said nut holder including a nut receiving portion having the center axis adapted to align with the center axis of said bolt turning tool in a vertical plane in the advanced position of the nut holder whereby the shoe bolt securing and removing is efficiently and precisely performed without tiring the operator.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

PREFERRED EMBODIMENT OF THE INVENTION

The present invention will be now described by way of one preferred embodiment of the present invention referring to the accompanying drawings.

Figure 1:
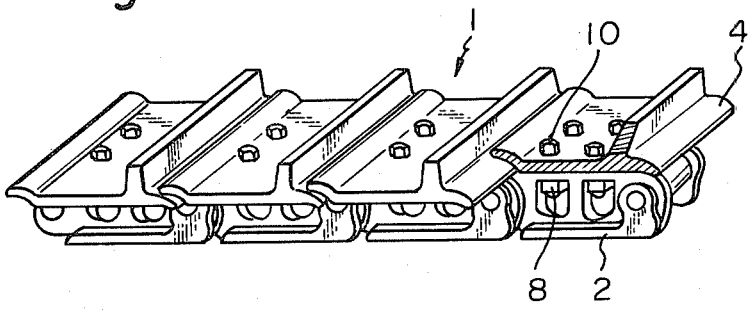
Fig. 1 is a fragmentary perspective view of a portion of a track chain.
Figure 2:
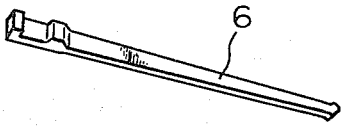
FIG. 2 is a perspective view of a nut wrench.
Figure 3:
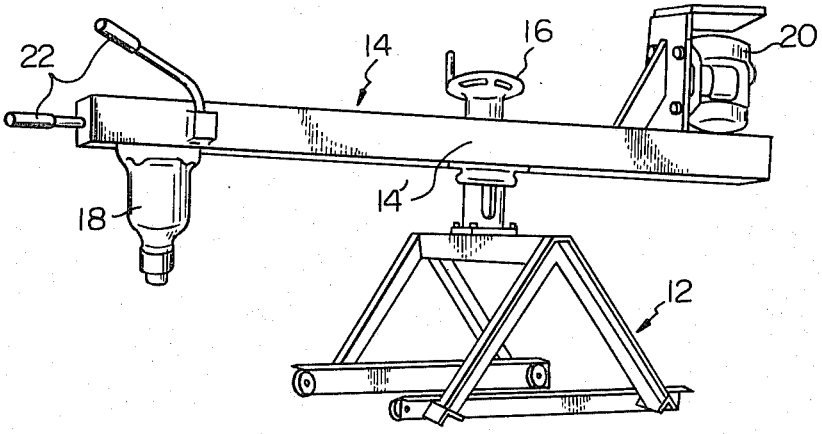
FIG. 3 is a perspective view of a conventional shoe bolt wrench.
Figure 4:
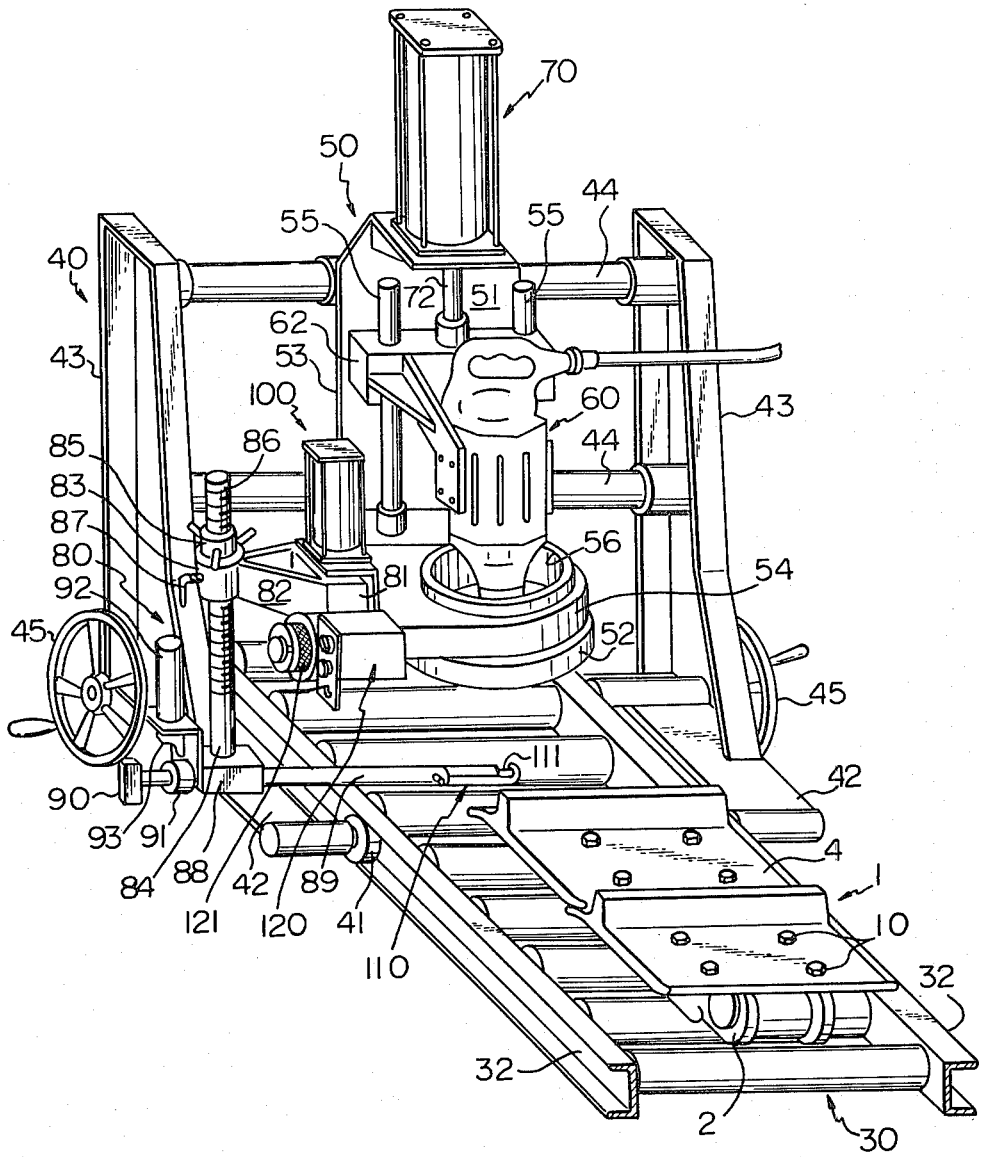
FIG. 4 is a perspective view of the shoe bolt securing and removing apparatus of the invention.

As more clearly shown in FIG. 4 in which the preferred embodiment of the invention is entirely illustrated, the shoe bolt securing and removing apparatus generally comprises a carriage 40 movable along the rails 32, 32 on the opposite sides of a conveyor 30 on which track chain 1 to and from which shoe bolts are to be secured and removed is carried, a mounting framework 50 slidably supported on the carriage 40 for movement transversely of the rails 32, 32 a pneumatic-type shoe bolt turning impact wrench 60 movably mounted on the mounting framework 50 for upward and downward movement, an air cylinder 70 for moving the impact wrench 60 upwardly and downwardly, a nut wrench support 80 movably mounted on the mounting framework 50 for upward and downward movement, an air cylinder 100 for moving the nut wrench support 80 upwardly and downwardly, a nut wrench 110 movably supported on the nut wrench support 80 below the impact wrench 60 for back and forth movement transversely of the rails 32, 32, and a centralized control device 120 mounted on the mounting framework 50 to deliver a series of operation commands to the impact wrench 60, nut wrench support 80 and other elements.

The carriage 40 comprises left- and right-hand bottom frames 42, 42 each including a pair of spaced front and rear rollers 41, 41 (only one roller 41 associated with the left-hand bottom frame 42 is shown in FIG. 4) received in and guided along the associated conveyor rail 32, upright side frames 43, 43 extending upwardly from the bottom frames 42, 42 and plurality of parallel transverse rods 44, 44 extending between and fixedly connecting the side frames 43, 43 at difference heights. Rotatably mounted on the side frames 43, 43 are handles 45, 45 to which drive wheels (not shown) are operatively connected through a gear train (not shown) and the drive wheels engage the rails 32, 32. Although the operator can move the carriage 40 along the rails by manually pushing the carriage, the carriage 40 can be more easily moved with only slight manual effort by turning one of the handles 45, 45. The movement of the carriage 40 by the manipulation of the handle 45 is advantageous when the carriage 40 is to be moved slightly so as to precisely align the socket at the leading end of the impact wrench 60 with the head of a particular shoe bolt 10.

The mounting framework 50 comprises a transversely movable member 53 of L-shaped cross-section including a vertical plate 51 slidably mounted on the transverse rods 44, 44 of the carriage 40 and a horizontal plate 52 integral with the vertical plate 51 and a turning member 54 movably mounted on the horizontal plate 52 of the member 53 for turning in a horizontal plane about the vertical axis of the impact wrench 60. Secured to the vertical plate 51 on the opposite sides of the latter are a pair of vertical guide rods 55, 55 on which a guide block 62 is slidably fitted and the guide block is secured to the impact wrench 60 by means of a mounting bracket. Connected to the upper surface of the guide block 62 in the center of the latter is the piston rod 72 of the air cylinder 70 the cylinder section of which is secured to the vertical plate 51. The horizontal plate 52 and the turning member 54 turnably mounted on the plate 52 are provided with aligned through openings 56 (only the opening 56 in the turning member 54 is shown in FIG. 4) through which the impact wrench 60 can extend. Thus, when the air cylinder 70 is actuated to extend or retract the piston rod 72, the impact wrench 60 is moved towards or away from the track chain 1 on the conveyor 30. The turning member 54 is limited in its turning movement by a suitable limit means (not shown) so that the turning member is allowed to turn on the horizontal plate 52 by 180° from the position as shown in FIG. 4 about the vertical axis of the impact wrench 60 whereby the nut wrench 110 is allowed to turn by 180° from the position as shown in FIG. 4 about the vertical axis of the impact wrench 60. And the cylinder section of the air cylinder 100 is secured to the periphery of the turning member 54 by means of a mounting bracket and the piston rod of the air cylinder 100 has the base 81 of the nut wrench support 80 secured thereto. Thus, when the air cylinder 100 is actuated to extend or retract the piston rod thereof, the entire nut wrench support 80 is moved downwardly or upwardly relative to the turning member 54.

Figure 5:
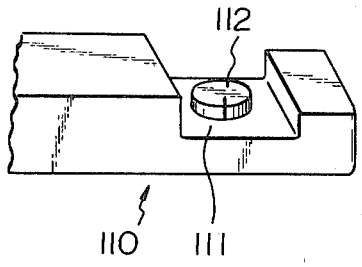
FIG. 5 is a fragmentary perspective view on an enlarged scale of the leading end portion of a shoe bolt fastening nut wrench to be employed in conjunction with the apparatus of the invention.

The nut wrench support 80 includes a cantilever arm 82 integrally extending from the base 81, a ring 83 secured to the leading end of the arm 82 and an upright rod 84 slidably received in the ring 83. The upper portion of the upright rod 84 is formed with threads 86 for receiving an adjusting set screw 85 thereon so that the height of the upright rod 84 can be adjusted by turning the screw 85 and the upright rod is held in the adjusted position by means of a lock screw 87 provided on the ring 83. The adjustment of the height of the upright rod 84 in the manner allows the nut wrench 110 to be positioned at any suitable height relative to track chains having different dimensions which are assembled or disassembled. Secured to the lower end of the upright rod 84 is a bearing block 88 which has a bearing hole (not shown) through which the mounting rod 89 of the nut wrench 110 is slidably received for back and forth movement transversely of the rails 32, 32. The nut wrench 110 is replaceably attached to the leading end of the mounting rod 89 and a handle 90 is attached to the rear end of the mounting rod 89 for moving the mounting rod 89 forwardly and backwardly. Secured to the mounting rod 89 adjacent to the handle 90 is a stopper 91 which limits the projecting distance of the mounting rod to thereby control the advancing distance of the nut wrench 110. In the advanced position, the center of the nut receiving recess 111 at the leading end of the nut wrench 110 aligns with the center of the socket of the impact wrench 60 in a vertical plane. And secured to the bearing block 88 by means of a mounting bracket is the cylinder section of an air cylinder 92 the piston rod of which has an engaging member 93 secured at the leading end of the piston rod for engaging the side of the stopper 91 whereby the mounting rod 89 and accordingly, the nut wrench 110 mounted on the rod can selectively be locked in advanced position. The bearing block 88 and mounting rod 89 are suitably provided with a key and a key way (not shown), respectively, so that in the retracted position, the mounting rod 89 is allowed to turn freely relative to the bearing block 88, but in the advanced position, the mounting rod 89 is held against rotation with the nut receiving recess 111 at the leading end of the nut wrench 110 precisely directed upwardly. Thus, when the operator turns the mounting rod 89 in its retracted position, the nut removed is allowed to drop from the nut wrench 110 at the leading end of the mounting rod 89 by its own gravity and the nut wrench 110 can be precisely directed upwardly by merely advancing the mounting rod 89. Furthermore, only for the purpose of fastening a shoe bolt, the nut wrench 110 replaceably attached to the leading end of the mounting rod 89 is provided with a short upright projection 112 in the center of the nut receiving recess 111 at the leading end thereof as shown in FIG. 5 for engaging in the threaded hole in a nut when the nut is loaded into the nut wrench 110, whereby the nut is prevented from inadvertently falling out from the nut wrench and the center axis of the shoe bolt and that of the nut can be positively prevented from being displaced from their aligned position.

Figure 6:
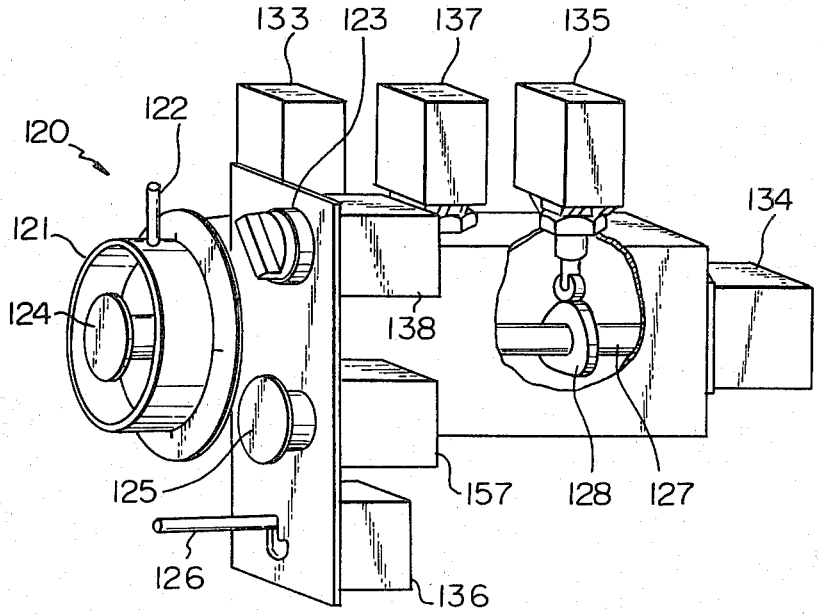
FIG. 6 is a perspective view on an enlarged scale of the centralized control device of the apparatus of the invention.

The centralized control device 120 is secured to the turning member 54 on the mounting framework 50 and adapted to turn about the impact wrench 60 together with the nut wrench support 80. The control device 120 is designed to operate the impact wrench 60, the nut wrench support 80 and the engaging projection 93 for the mounting rod 89 in a predetermined sequence in accordance with different operations such as "assembling" and "disassembling" by the shoe bolt securing and removing apparatus. A series of cam plates 128 (only one is shown) are angularly mounted on the hollow shaft of a dial 121 (FIG. 6) about the dial shaft 127 for engaging a series of selector valves 133, 135, 137, respectively. As the pointer of the dial 121 is turned in increments to pass in succession along a series of displays such as "descend", "start", "release" and "termination" provided on a display plate 122, different operation steps can be performed in succession in a predetermined sequence as will be described hereinafter. For the operation of the impact wrench, the nut wrench support and the bearing block engaging projection in a predetermined sequence, different circuits can be selected by selector valve 138 by shifting a selector button 123 to "assembling" or "disassembling" as will be described hereinafter, whereby partially different operation steps can be performed. And provided in the center of the dial 121 is a push button 124 having a shaft extending through the hollow interior of the hollow dial shaft and the leading end of the push button shaft is provided with a selector valve 134 for operating the impact wrench 60 independently of the operation of the dial. By depressing the push button 124, the impact wrench 60 can be turned at any suitable time.

Further, there is provided a lever 126 which shifts a selector valve 136 to temporarily stop the downward movement of the impact wrench in its descend stroke and a push button 125 which shifts a selector 157 to temporarily raise the impact wrench 60.

The operation of the embodiment as described hereinabove is explained referring to the pneumatic circuit of Fig. 7 as follows. First, the track chain 1 is laid onto the conveyor 30 in its extended condition (for disassembling) as shown in FIG. 4 or track shoes 4 are laid onto track links 2 (for assembling) as shown in the same figure. Thereafter, the carriage 40 is bodily moved along the rails 32, 32 by manually pushing the carriage or turning the selected one of the handles 45, 45 for the alignment of the socket at the leading end of the impact wrench 60 with the head of a particular shoe bolt 10 to be secured to or removed from the track chain 1 in the longitudinal direction of the rails. Thereafter, the mounting framework 50 is moved along the transverse rods 44, 44 transversely of the rails 32, 32 for the alignment of the socket at the leading end of the impact wrench 60 with the shoe bolt head also in the transverse direction of the rails. The transverse movement of the mounting framework 50 can be attained with a low force ranging from 2 to 3 kg. Next, the set screw 85 is adjusted to bring the nut wrench 110 to a suitable height and the nut wrench is set in the adjusted position by fastening the set screw 87. Thereafter, a nut is loaded into the nut receiving recess 111 of the nut wrench for assembling or the nut is not loaded into the nut receiving recess for disassembling and the nut wrench 110 is extended from the retracted position to the advanced position.

Thereafter, the dial 121 of the control device 120 is turned to operate the impact wrench 60, the nut wrench support 80 and the bearing block engaging member 93 in a predetermined sequence.

That is, first of all, the dial 121 is turned to bring the pointer thereof to "descend" on the display plate 122 whereupon the cam plates 128 shift the selector valves 135, 137 and the pneumatic circuit is opened to the selector valve 138 which selects "assembling" or "disassembling" circuit. Namely, the pilot air pressure is led to the selector valve 143 through one of the selector valves 135, 137 to shift the selector valve 143, thereby the supply of the actuating air pressure to the piston end of the air cylinder 70 through the selector valves 143, 142 and the flow rate regulator valve **152-*c* is terminated and the piston end of the air cylinder 70 is opened to the atmosphere through the flow rate regulator valve 152-*c* and the selector valves 142, 143 and 144. Thus, the impact wrench 60 falls down by its own gravity with introducing of air into the head end of the air cylinder 70 through a flow rate regulator valve 152-*a***.

In this case, when the lever 126 is pushed down and the selector valve 136 is shifted to the open position during the descend movement of the impact wrench 60, the pilot air pressure which passed through the selector valve 136 shifts the selector valve 142 to its closed position thereby the descent of the impact wrench by its own gravity is stopped. With the impact wrench 60 in this "dead" position, the operator determines whether the socket of the impact wrench 60 is positioned just above the shoe bolt head or not. If the socket is found not to be in vertical alignment with the bolt head, the position of the socket is finely adjusted with the lever held pushed down by hand or locked by shifting the lever transversely.

Figure 7:
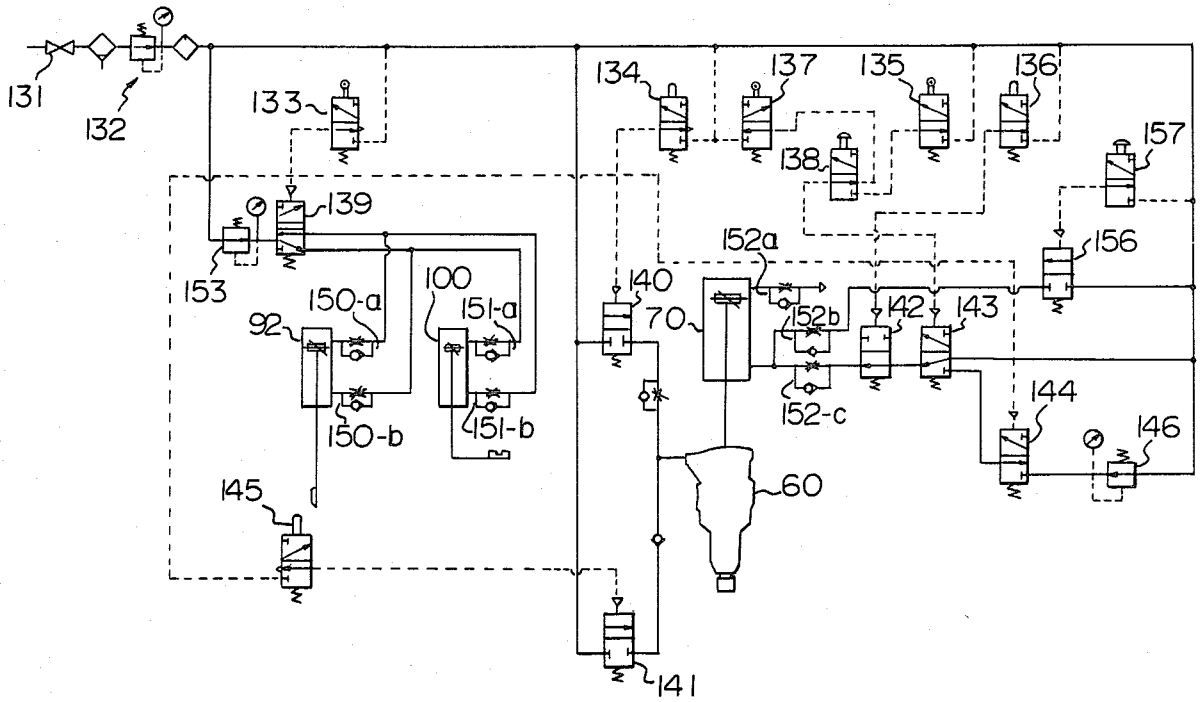
FIG. 7 is a diagrammatic view showing a pneumatic circuit for operating the apparatus of the invention.

When the lever 126 is released or unlocked, the pilot air pressure leading to the selector valve 142 is lieved to the atmosphere through the selector valve 136 and the valve 142 returns to its original position (shown in FIG. 7). Thus, the piston end of the air cylinder 70 is reopened to the atmosphere through the regulator valve 152-*c* and the selector valves 142, 143 and 144 and the impact wrench 60 descends again until the socket fits on or abuts against the bolt head whereupon the impact wrench ceases its downward movement. At this time, the push button 124 is pushed down for a brief length of time to shift the selector valve 134 to open position which in turn shifts the selector valve 140 associated with the pneumatic circuit for rotating the impact wrench to open position for a brief time whereby the impact wrench 60 is finely turned to cause the socket of the impact wrench 60 to precisely fit on the bolt head.

As the dial 121 is further turned in increments to bring the pointer thereof to "start" on the display plate 122, the selector valves 135, 137 are held in their open position by the engagement with the corresponding cam plates 128, and further the selector valve 133 is shifted to its open position by the engagement with the corresponding cam plate 128. By this, the pilot air pressure is led to the selector valve 139 through the valve 133 to shift the valve 139 to its open position, whereby the air with its pressure reduced by pressure-reduce valve 153 is supplied to the head end of the air cylinder 92 and to the piston end of the air cylinder 100. When the air pressure is introduced into the air cylinder 100 at the piston end thereof to raise the nut wrench support 80 bodily whereby the leading end of the nut wrench holding the nut abuts against the lower end of the shank of the corresponding bolt for assembling or the nut receiving recess 111 at the leading end of the nut wrench 110 fits on the nut head for disassembling. Simultaneously, as air pressure is introduced into the air cylinder 92 at the head end thereof to cause the engaging member 93 to descend whereby the mounting rod 89 is locked in its advanced position. When the engaging member 93 descends to the locking position, the selector valve 145 is actuated to open the selector valve 141 in the pneumatic circuit associated with the impact wrench 60 to thereby turn the socket at the leading end of the impact wrench 60. The suitable fastening and loosening of the bolt as the result of the turning of the impact wrench 60 can be determined by counting the number of times impact noise occurs and by visual observation, respectively.

Incidentally, flow rate regulating valves 150-*a*, 150-*b* and 151-*a*, 151-*b* associated with the air cylinders 92 and 100 respectively are provided in order to move the piston of the air cylinder 100 faster than that of the air cylinder 92. Also, during the rotation of the impact wrench 60, as the pilot air pressure is led to the selector valve 144 through the valve 133 to shift the valve 144 to open position, air with its pressure reduced by a pressure-reduce valve 146 is supplied to the piston end of the air cylinder 70 through the valves 146, 144, 143, 142 and the flow rate regulating valve 152-*c* whereby the weight of the impact wrench is supported by the air pressure introduced to the air cylinder to prevent the weight of the impact wrench from being applied directly to the socket thereof.

After the termination of the suitable fastening or loosening of the bolt in the manner mentioned above, the dial 121 is further turned in increments to bring the pointer thereof to "release" on the display plate 122. On this "release" position, the action of the impact wrench 60 in "assembling" is different from that in "disassembling", one of which is selected by shifting the selector valve 138 by the selector button 123. This is due to its difference in configuration of the cam plates 128 which engage with the selector valves 135 and 137. When the pointer of the dial 121 is in "release" position, the selector valves 133, 135 and 137 are in "closed", "closed" and "open" positions, respectively. Thus, if the selector valve 138 is moved to the "assembling" position (as shown in FIG. 7) in the "release" position, the pilot air pressure which passed through the valve 137 is led to the selector valve 143 through the valve 138 to shift the valve 143 from the position as shown in FIG. 7 to the other position. By this, the piston end of the air cylinder 70 is open to the atmosphere through the flow rate regulating valve 152-*c* and the selector valves 142, 143 and 144 and the impact wrench 60 is held in its "descend" position. At this time, air pressure is introduced into the air cylinder 100 at the head end thereof to cause the nut wrench support 80 to descend bodily and at the same time, air pressure is also introduced into the air cylinder 92 at the piston end thereof to raise the engaging member 93 so as to disengage the member from the stopper 91 whereby the mounting rod 89 is unlocked. When the engaging member 93 is disengaged from the stopper 91, the selector valve 145 is returned to the position shown in FIG. 7, and, therefore, the selector valve 141 is shifted to "closed" position to thereby block the supply of pressurized air to the impact wrench 60 and the rotation of the impact wrench 60 is stopped. Also, at this time, as the supply of the pressurized air to the selector valve 144 through the valve 133 is stopped, the valve 144 returns to the position as shown in FIG. 7 as stated above.

On the other hand, if the selector valve 138 is moved to "disassembling" in the "release" position, as the selector valve 135 is closed, the pilot air pressure is not led to the selector valve 143 and the valve 143 is held in the position as shown in FIG. 7. Therefore, actuating pressure air is supplied to the piston end of the air cylinder 70 through the selector valves 143, 142 and the flow rate regulating valve 152-*c* to raise the impact wrench 60 from the "descend" position. At the same time, as air pressure is introduced into the air cylinder 100 at the head end thereof and also into the air cylinder 92 at the piston end thereof as in the case of "assembling", the nut wrench support 80 bodily descends, the engaging member 93 is disengaged from the stopper 91 to unlock the mounting rod 89 and the rotation of the impact wrench 60 is stopped in the same manner as mentioned in connection with "assembling".

As the dial 121 is further turned in increments to bring the pointer thereof the "termination" on the display plate 122, when the selector button 123 selects the circuit for assembling, the selector valve 137 is shifted to closed position as shown in FIG. 7 by the action of the cam plate 128 and air pressure is introduced into the air cylinder 70 at its piston end through the valves 143, 142 and 152-*c* and the impact wrench 60 rises to its upper limit position and stops there and when the selector 123 selects the circuit for disassembling, the action similar to that in the "release" position is continued until the turning of the impact wrench 60 is terminated.

After a series of operations have been performed in response to the incremental turning of the dial 121 in the manner mentioned above, the mounting rod 89 is moved back to the retracted position and for the disassembling operation, the mounting rod 89 is turned within the bearing block 88 to allow the nut to fall out by its own gravity. After the securing or removing of one shoe bolt has been completed, when the next shoe bolt is to be secured to or removed from the track chain 1, the selected handle 45 is turned to move the entire apparatus along the rails 32, 32 in the longitudinal direction of the conveyor 30 and move the mounting framework 50 along the transverse rods 44, 44 in the transverse direction of the conveyor until the socket of the impact wrench 60 comes into alignment with the bolt head in a vertical plane and thereafter, the above-mentioned operation procedure is repeated. After the securing or removing operation has been performed on all the shoe bolts for one side of the track chain 1, the turning member 54 on the mounting framework 50 is turned by 180° to move the nut wrench support 80 to the other side of the track chain 1. Thereafter, the same operation procedure is repeated for the other or opposite side of the track chain 1 until all the shoe bolts are secured to or removed from the track chain.

In the embodiment illustrated and described hereinabove, although the turning member 54 of the mounting framework 50 is turnable about the impact wrench 60 whereby the nut wrench 110 is allowed to advance from the opposite sides of the track chain 1 to a predetermined advanced position through the opening in track link 2, it is also comtemplated that the shoe bolt securing or removing operation can be equally performed by moving the nut wrench 110 to the advanced position through the track link 2 from only one side of the track chain 1. In such a case, the turning member 54 of the mounting framework 50 can be formed integral with the transversely movable member 53. And although the impact wrench 60 is employed as the shoe bolt fastening or loosening wrench in the illustrated embodiment, other power driven rotary wrenches may be also employed in place of the impact wrench 60 without departing from the scope of the invention. Furthermore, in the illustrated embodiment, although the centralized control device 120 is employed for operating the air cylinders 70, 92, 100 in a predetermined sequence in response to the turning of the dial 121 in increments, the centralized control 120 is not necessarily required in the apparatus of the invention and instead separate selectors for controlling the air cylinders 70, 92, 100 can be suitably disposed in different positions. Furthermore, in the illustrated embodiment although the air cylinders are particularly employed as means for moving the impact wrench 60 and nut wrench support 80 upwardly and downwardly and operating the lock for the nut wrench mounting rod 89, the air cylinders can be replaced by other means such as hydraulic cylinders without departing from the spirit of the invention.

As is clear from the foregoing description of the embodiment of the invention, according to the present invention, in the shoe bolt securing or removing operation, the center of the nut receiving socket of the nut wrench can be precisely aligned with the axis of the bolt in a vertical plane by merely moving the nut wrench to the advanced position and accordingly, the aligning of the nut can be easily achieved by effecting positioning operation only on the shoe bolt side whereby the aligning can be performed by a single operator resulting in substantial reduction of manual effort. And the positioning operation can be achieved by moving the carriage in the longitudinal direction of the track chain through the turning of either one handle and slidably moving the mounting framework relative to the carriage in the transverse direction of the track chain with a low force and since the nut wrench is not required to be manually held during the turning of the bolt turning tool, physical fatigue on the part of the operator can be substantially reduced. Furthermore, since the bolt turning tool is movable upwardly and downwardly the socket of the nut wrench can be precisely fitted on the bolt head regardless of variation in dimensions of track chains. And when the centralized control device is employed in association with the dial, a series of steps involved in the shoe bolt securing or removing operation can be promptly and efficiently performed whereby the operation efficiency can be substantially improved.

While only one embodiment of the invention has been shown and described in detail, it will be understood that the same is for illustration purpose only and not to be taken as a definition of the invention, reference being had for this purpose to the appended claims.

What is claimed is:

1. A shoe bolt securing and removing apparatus comprising a carriage movable along rails, a mounting framework movably supported on said carriage for movement transversely of said rails, a power driven rotary bolt turning tool mounted on said mounting framework for upward and downward movement, means supported on said mounting framework for moving said bolt turning tool upwardly and downwardly, a nut holder support supported on said mounting framework for upward and downward movement, means supported on said mounting framework for moving said nut holder support upwardly and downwardly and a nut holder supported on said nut holder support below said bolt turning tool for movement back and forth transversely of said rails, said nut holder including a nut receiving portion having the center axis adapted to align with the center axis of said bolt turning tool in a vertical plane in the advanced position of the nut holder.

2. The shoe bolt securing and removing apparatus as set forth in claim 1, in which said mounting framework includes a transversely movable portion supported on said carriage for movement transversely of said rails and a turning portion mounted on said transversely movable portion for turning in a horizontal plane, said bolt turning tool and said means for moving the bolt turning tool upwardly and downwardly being supported on said transversely movable portion, said nut holder support and said means for moving said nut holder support upwardly and downwardly being supported on said turning portion and said turning portion being turnable about the vertical axis of said bolt turning tool.

3. The shoe bolt securing and removing apparatus as set forth in claim 1 or 2, in which said nut holder support is provided with means for locking said back and forth movement of said nut holder.

4. The shoe bolt securing and removing apparatus as set forth in claim 2, in which a centralized control device is secured to said turning portion for delivering a series of operation commands to said means for moving said turning tool upwardly and downwardly, said means for moving said nut holder support upwardly and downwardly and said nut holder locking means.

5. The shoe bolt securing and removing apparatus as set forth in claim 1, in which said bolt turning tool comprises an impact wrench.

6. The shoe bolt securing and removing apparatus as set forth in claim 1, in which said nut receiving portion is provided with a recess for receiving a nut and a short upright projection formed in the center of said recess for engaging in the hole in said nut.

7. The shoe bolt securing and removing apparatus as set forth in claim 1, in which said means for moving said bolt turning tool upwardly and downwardly and said means for moving said nut holder support upwardly and downwardly comprise pneumatic piston-cylinder units, respectively.

* * * * *